United States Patent [19]

Gunneman

[11] Patent Number: 4,601,314

[45] Date of Patent: Jul. 22, 1986

[54] METHOD AND APPARATUS FOR OPERATING A WEAVING MACHINE

[75] Inventor: Paul Gunneman, Mierlo, Netherlands

[73] Assignee: Sulzer-Ruti Machinery Work, Ltd, Ruti, Switzerland

[21] Appl. No.: 692,205

[22] Filed: Jan. 17, 1985

[30] Foreign Application Priority Data

Jan. 19, 1984 [CH] Switzerland ..... 235/84

[51] Int. Cl.[4] ..... D03D 47/00

[52] U.S. Cl. ..... 139/429; 139/435; 139/450

[58] Field of Search ..... 139/429, 435, 450, 194

[56] References Cited

U.S. PATENT DOCUMENTS

| | | | |
|---|---|---|---|
| 2,519,786 | 8/1950 | Paabo | 139/435 |
| 3,269,426 | 8/1966 | Llado | 139/450 |
| 3,665,976 | 5/1972 | Freihofer | 139/450 |
| 3,698,442 | 10/1972 | Sakamoto | 139/435 |
| 3,938,561 | 2/1976 | Scheffel | 139/435 |
| 4,054,159 | 10/1977 | Juillard | 139/450 |
| 4,473,096 | 9/1984 | Brouwer et al. | 139/194 |
| 4,481,982 | 11/1984 | Ogasawara et al. | 139/450 |

*Primary Examiner*—Henry S. Jaudon

*Attorney, Agent, or Firm*—Kenyon & Kenyon

[57] ABSTRACT

The picking apparatus operates to pick a weft yarn into a shed with a predetermined excess length. A weft stretching nozzle receives the excess length at the forward end of the weft thread while stretching the weft yarn from the catching side of the shed. After termination of picking and during an initial phase of the beating-up movement of the reed, the weft yarn is pulled back on the picking side by the amount of the excess length. The stretching effect on the weft yarn is effective and uniform and obtains a better fabric during weaving.

5 Claims, 2 Drawing Figures

METHOD AND APPARATUS FOR OPERATING A WEAVING MACHINE

Figure 1:
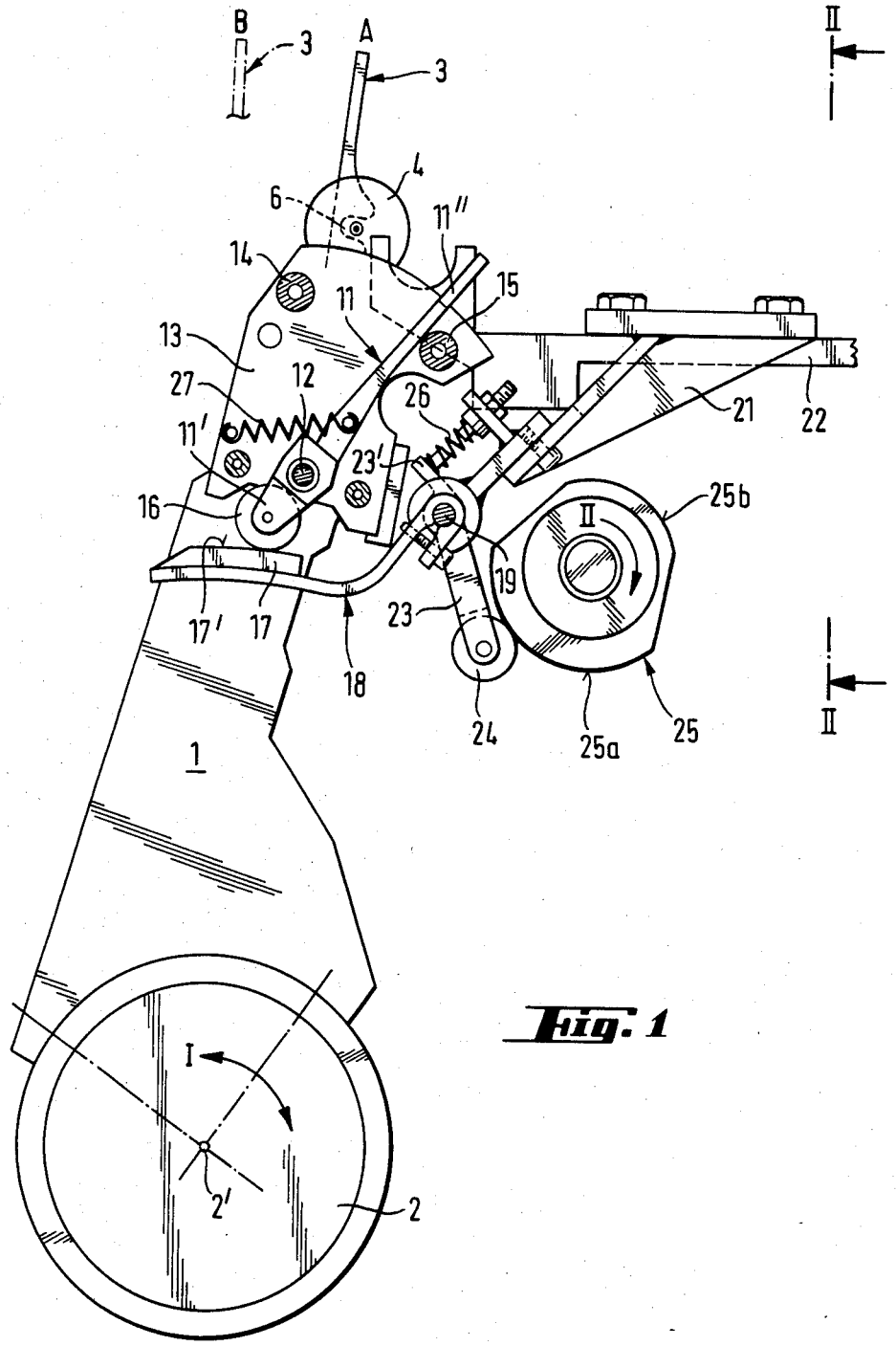

This invention relates to a method and apparatus for operating a weaving machine. More particularly, this invention relates to a method and apparatus for picking a weft yarn into a shed in a weaving machine. Still more particularly, this invention relates to a method and apparatus for picking a weft yarn into a weaving shed using a fluid stream.

As is known, the quality of a woven fabric depends in large measure upon the extent and uniformity with which weft yarns are stretched after picking and are kept stretch in the fabric during a subsequent beating-up. In the case of weaving machines which employ a fluid stream, such as air, to pick a weft yarn, it has been known to effect a stretching of the weft yarn by means of a stretching nozzle which is provided on the catching side of the shed. As a rule, the stretching nozzle is positioned outside the edge of the fabric being woven. Also, the stretching nozzle is provided in addition to a number of relay nozzles which are usually distributed over the shed for the picking of the weft yarn.

Of course, stretching is more effective and more uniform, and the cloth is correspondingly better, when the weft yarn is surrounded over a relatively considerable length by a stretching air stream of the stretching nozzle. Thus, it is advantageous for the stretching effect if the weft yarns are picked with a length such as to project fairly far beyond the cloth edge on the catching side after picking. However, this would entail a relatively substantial and, therefore, uneconomical yarn waste length.

Accordingly, it is an object of the invention to ensure an optimum stretching of a weft yarn with a reduced waste length during picking.

It is another object of the invention to provide a relatively simple technique for stretching a weft yarn in a shed while maintaining the stretched condition of the yarn during beating-up.

It is another object of the invention to provide a relatively simple apparatus for stretching weft yarns in a weaving machine of a type in which a weft yarn is picked using a fluid stream.

It is another object of the invention to improve the quality of a fabric woven in a weaving machine in which weft yarns are picked via a fluid stream.

Briefly, the invention provides a method of operating a weaving machine which is comprised of the steps of picking a weft yarn into and through a shed with an excess length, imposing a fluid stream on the forward end of the weft yarn in order to stretch the yarn, and thereafter pulling back the picked weft yarn on the picking side of the shed by an amount equal to the excess length while beating-up the stretched weft yarn.

The invention also provides an apparatus for picking a weft yarn into a shed in a weaving machine. This apparatus includes a main picking nozzle for picking a weft yarn into a shed, a weft stretching nozzle on a catching side of the shed for receiving and stretching the weft yarn, a reed for beating-up of a weft yarn within the shed, means upstream of the main nozzle for pulling back a predetermined length of the picked weft yarn and a weft yarn cutter between the main nozzle and reed for severing a picked weft yarn.

In accordance with the invention, weft yarns are picked into the shed with an excessive length so that they project correspondingly far out of the shed on the catching side with the stretching nozzle acting on the excess length. After termination of picking and in the initial phase of the beating-up movement of the reed, the weft yarns are pulled back on the picking side by the amount of the excess length.

Of note, it has been known in the case of a gripper projectile weaving machine for a weft yarn which has been picked into a shed to be pulled back some distance. This occurs when the projectile, after having been retarded in a catcher and stopped, is moved back by the distance the projectile has penetrated into the catcher. In order to ensure that the weft yarn is not left unstretched in the shed, the weft yarn is pulled back at the same time. However, in the method according to the invention, the weft yarn is deliberately picked with an excess length and pulled back after picking by the amount of the excess length.

Figure 2:
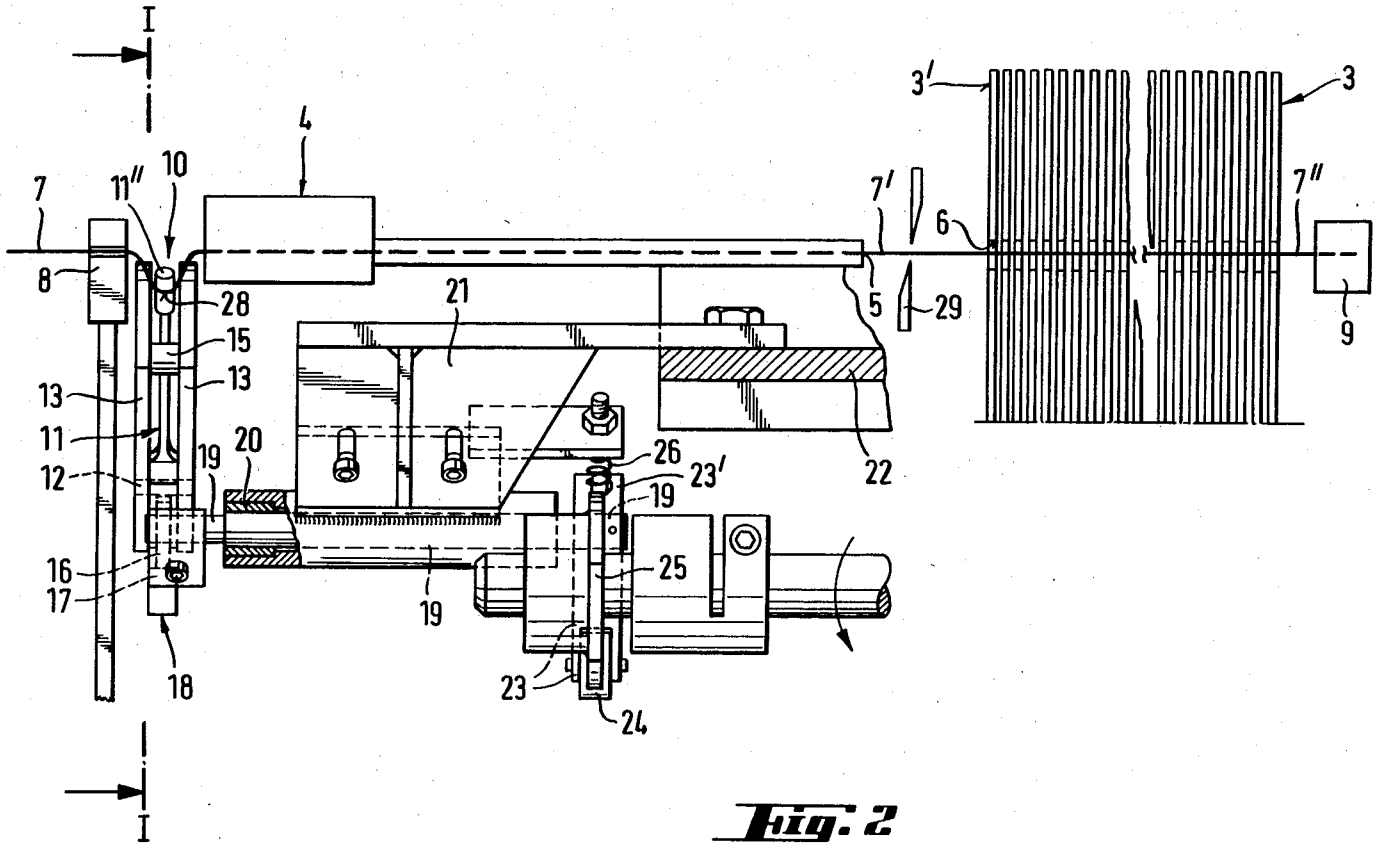

These and other objects and advantages of the invention will become more apparent from the following detailed description taken in conjunction with the accompanying drawings wherein:

FIG. 1 illustrates a side view of the picking side of a weaving machine constructed in accordance with the invention; and FIG. 2 illustrates a view taking on line II—II of FIG. 1.

Referring to FIGS. 1 and 2, the weaving machine is constructed with an apparatus for picking a weft yarn into a shed using a fluid stream such as air. To this end, only those parts necessary for an understanding of the structure of the apparatus for picking the weft yarn will be described hereinafter.

Referring to FIG. 1, the weaving machine includes a sley 1 which is mounted on a shaft 2 which is reciprocable about an axis of rotation 2' as indicated by an arrow I. This sley 1 carries a reed 3 and, on the picking side of the weaving machine, extends some distance beyond the boundary 3' of the reed 3 (see FIG. 2).

The apparatus for picking a weft yarn 7 includes an air jet main picking nozzle 4 which is mounted on the projecting end of the sley 1. This nozzle 4 has a weft exit orifice 5 which is disposed opposite a weft picking channel 6 formed in the lamellae of the reed 3. The weft yarn 7 is supplied from a supply bobbin (not shown) via a weft-metering device (not shown), such as a weft yarn storage device and by way of a yarn clamp 8 to the main nozzle 4. The clamp 8 closes after the termination of each pick and reopens only at the time when the next pick is required to start. The length of yarn stored at this time for the next pick in the yarn storage device is then released by the opening of the clamp 8 in order to be picked by the main nozzle 4. The length of yarn stored is equal to the length of weft yarn required by cloth width plus a predetermined excess length.

Referring to FIG. 2, an air jet weft stretching nozzle 9 is provided on the opposite side of the reed 3, i.e. on the catching side of the shed, for receiving the forward end 7'' and for stretching the weft yarn 7. The stretching nozzle 9 is shown only diagramatically and is not otherwise described since such is known, for example from Dutch Pat. No. PS 7206367.

The picking apparatus also includes a means upstream of the main nozzle 4 for pulling back a predetermined length of the picked weft yarn 7. This means includes a two-armed lever 11 which is disposed in a space 10 between the yarn clamp 8 and the main nozzle 4. This lever 11 is mounted on a spindle 12 so as to rotate in a plane transverse to the weft yarn 7, i.e. perpendicular to the picking line, in order to deflect the weft yarn into a loop 28. As shown in FIG. 2, the spindle 12 is mounted in two uprights 13 which are secured to the top of the projecting part of the sley 1 (see FIG. 1). The lever 11 moves between an inoperative position, determined by an abutment 14, and an operative position, determined by an abutment 15. Both abutments 14, 15 are mounted between the uprights 13.

As shown in FIG. 1, the bottom arm 11' of the lever 11 carries a roller 16 which is adapted to roll on a guide bar 17 which, in turn, is mounted on a lever 18. This lever 18 is secured on a spindle 19 which extends parallel to the picking line and which is rotatably mounted in a collar 20 (FIG. 2). This collar 20 is secured by way of a support member 21 on a stationary part 22 of the weaving machine.

A lever 23 is also mounted on the spindle 19 and carries a cam follower 24 at one end which is guided on a cam 25 which is rotatable in a direction as indicated by an arrow II (See FIG. 1) . In addition, a compression spring 26 presses against a projecting part 23' of the lever 23 to keep the cam follower 24 in engagement with the cam 25. As indicated in FIG. 1, the spring 26 is fixedly mounted at one end to a suitable bracket which is secured on the support member 21.

The cam 25 has two camming parts **25*a*, 25*b* of different radii which are interconnected by straight transition parts. In the position shown in FIG. 1, the reed 3 is in the beating-up position A and the larger-radii camming part 25*a* is operative. Thus, the lever 18 with the guide bar 17 is in a top position in which the guide bar edge 17' is disposed on a circular arc whose center coincides with the axis of rotation 2' of the sley 1. In this position, the lever 11 is pressed against the force of a tension spring 27 into the operative position on the abutment 15. In this position, the upwardly extending arm 11'' of the lever 11 maintains a weft yarn loop 28, one arm of which extends to the yarn clamp 8 and the other arm of which extends to the main nozzle 4 (see FIG. 2**).

Of note, the loop of yarn 28 arises during the beating-up movement of the reed which precedes the position B of the reed. In this movement, the lever 11 is turned from its inoperative, i.e. no-loop, position on the abutment 14 into the operative, i.e. loop-forming, position on the abutment 15. The length of yarn contained in the loop is intended to be used during the next pick of the weft yarn.

As shown in FIG. 2, a weft yarn cutter 29 is disposed between the main nozzle 4 and the reed 3 for severing a picked weft yarn.

The operation of the apparatus will be described hereinafter with reference to a weaving cycle, the starting position being the reed beating-up position A shown in the drawings. The most important events in the weaving cycle are referred to the angular position of the machine main shaft (not shown) which performs one complete revolution per weaving cycle. The position A corresponds to a position of 0°.

In the position illustrated or a few degrees previously, the beaten-up weft yarn has been severed. The now commencing return movement of the sley 1—to the left in FIG. 1—does not initially cause the lever 11 to rotate since the cam 25 initially remains operative by way of the camming part **25*a* on the lever 18. Thus, the lever 11 stays in the raised position. Consequently, the cam follower 16 of the lever 11 remains in contact with the guide bar edge 17' and rolls on the edge 17' without altering the position of the lever 11**.

Only after the machine main shaft has rotated through an angle of about 90° does the smaller-radius camming part **25*b* come into operation. At this time, the spring 27 can rotate the lever 18 counter-clockwise, the guide bar 17 moving away from the cam follower 16. The tension spring 27 can now rotate the lever 11 counter-clockwise into engagement with the abutment 14. Either approximately at the same time or a few degrees previously, the main nozzle 4 starts to be supplied with compressed air and the yarn clamp 8 opens. Meanwhile, shed changing has occurred and the new shed already opened to an extent such that the necessary passage for the next weft yarn is present. The pull exerted by the main nozzle 4 on the weft yarn raises, and conveys towards the shed, the loop 28 which the lever 11 released as the lever 11 moved towards the abutment 14**. The weft yarn is therefore picked approximately between 90° and 100° main shaft angle.

At approximately 180°, the sley 1 has reached the inoperative position. The reed 3 is then in position B. The main nozzle 4 is still inoperative, being cut out of the operation at 230° main shaft angle.

The stretching nozzle 9 comes into operation at approximately 200° in order to be able to receive the weft end 7'' at the end of the picking and to start stretching. At this time, a pneumatic stream is imposed on the forward end 7'' of the weft yarn to stretch the yarn within the shed. The stretching nozzle 9 contains a length of weft yarn equal to the length of the loop 28. The sley 1 with the reed 3 is meanwhile moving to the right again towards the position A illustrated. Near the end of the beating-up movement, the camming part **25*a* acts on the cam follower 24 of the lever 23 so that the lever 23 rises and rotates the lever 11 clockwise. The lever 11 thus pulls a loop 28 into the weft yarn which is still moving in the shed and which is engaged at the forward end by the stretching nozzle 9**.

When the loop 28 is formed in the weft yarn 7', the yarn is pulled back out of the shed by a corresponding amount until the time, for instance, at 350°, at which the weft yarn is severed by the cutter 29.

If the weft yarn severance occurs when the lever 11 is moving from the left-hand inoperative position into the right-hand operative loop-forming position as viewed in FIG. 1, the pulling-back of the weft yarn from the shed continues for some time after severance. The result of this, as previously stated, is that the head of the next weft yarn remaining after severance is at some considerable distance away from the shed entry. This makes it possible to open the yarn clamp 8 eariler and to cut in the main nozzle 4 earlier, so that the head of the weft yarn is already moving at an appreciable speed at the time when the shed opening is large enough for picking to be able to begin.

The invention thus provides a relatively simple method of pneumatically picking a weft yarn into a shed in stretched condition and of thereafter beating-up the stretched yarn into a fabric while maintaining the stretched condition of the yarn. In this way, a better fabric can be obtained.

The invention further provides a relatively simple apparatus for picking a weft yarn into a shed while maintaining the weft yarn in a stretched condition.

The invention further provides an apparatus for picking a weft yarn into a shed and for effecting a beating-up operation with a minimum of yarn waste.

What is claimed is:

1. A method of operating a weaving machine comprising the steps of pneumatically picking a weft yarn into and through a shed with an excess length;

imposing a fluid stream on the forward end of the picked weft yarn to stretch the weft yarn;

thereafter pulling back the picked weft yarn on the picking side of the shed an amount equal to the excess length while beating-up the stretched weft yarn; and severing the weft yarn while maintaining the pulling back of the weft yarn until shortly after severance.

2. A method of operating a weaving machine comprising the steps of pneumatically picking a weft yarn into and through a shed with an excess length;

imposing a pneumatic stream on the forward end of the weft yarn to stretch the weft yarn within the shed;

beating-up the stretched weft yarn into a fabric;

forming a loop in the picked weft yarn upstream of the shed to pull back the weft yarn an amount equal to the excess length during beating-up of the weft yarn; and severing the weft yarn while maintaining the pulling back of the weft yarn until shortly after severance.

3. An apparatus for picking a weft yarn into a shed in a weaving machine, said apparatus comprising a main picking nozzle for picking a weft yarn into a shed;

a weft stretching nozzle on a catching side of the shed for receiving and stretching the weft yarn;

a reed for beating-up a weft yarn within the shed;

a weft yarn cutter between said main nozzle and said reed for servering a picked weft yarn; and means upstream of said main nozzle for pulling back a predetermined length of the picked weft yarn until shortly after severing.

4. An apparatus as set forth in claim 3 which further comprises a reciprocable sley carrying said reed and said main nozzle thereon.

5. An apparatus as set forth in claim 4 wherein said means for pulling back the weft yarn includes a lever rotatably mounted on said sley, said lever being disposed to rotate in a plane transverse to a weft yarn to deflect the weft yarn into a loop during movement of said reed and said sley in a beating-up direction.

* * * * *

UNITED STATES PATENT AND TRADEMARK OFFICE

CERTIFICATE OF CORRECTION

PATENT NO. : 4,601,314

DATED : July 22, 1986

INVENTOR(S) : Paul Gunnenman

It is certified that error appears in the above-identified patent and that said Letters Patent is hereby corrected as shown below:

Column 1, line 15 change "stretch" to -stretched-

Column 4, line 52 change "eariler" to -earlier-

Signed and Sealed this

Seventeenth Day of March, 1987

*Attest:*

DONALD J. QUIGG

*Attesting Officer*

*Commissioner of Patents and Trademarks*